US006517128B2

(12) United States Patent
Perkins et al.

(10) Patent No.: US 6,517,128 B2
(45) Date of Patent: Feb. 11, 2003

(54) VEHICLE DOOR LATCH WITH POWER OPERATED RELEASE MECHANISM

(75) Inventors: Donald Michael Perkins, Troy, MI (US); Frank Joseph Arabia, Jr., Macomb, MI (US); Jeffery P Laukonis, Macomb, MI (US); Brent J Williams, Bloomfield, MI (US); Peter Siegfried Pajak, Wuppertal (DE)

(73) Assignee: Delphi Technologies, Inc., Troy, MI (US)

( * ) Notice: Subject to any disclaimer, the term of this patent is extended or adjusted under 35 U.S.C. 154(b) by 33 days.

(21) Appl. No.: 09/777,791

(22) Filed: Feb. 6, 2001

(65) Prior Publication Data

US 2002/0105192 A1 Aug. 8, 2002

(51) Int. Cl.[7] ..... E05C 3/06

(52) U.S. Cl. ..... 292/216; 292/DIG. 23; 292/201

(58) Field of Search ..... 292/201, 216, 292/DIG. 23; 70/275, 279.1, 263, 264

(56) References Cited

U.S. PATENT DOCUMENTS

| | | | | | |
|---|---|---|---|---|---|
| 4,969,672 | A | * | 11/1990 | Childs et al. | 292/201 |
| 5,802,894 | A | * | 9/1998 | Jahrsetz et al. | 292/144 |
| 5,918,917 | A | * | 7/1999 | Elton et al. | 292/201 |
| 6,053,543 | A | * | 4/2000 | Arabia et al. | 292/201 |
| 2001/0038211 | A1 | * | 11/2001 | Hayakawa et al. | 292/201 |

* cited by examiner

*Primary Examiner*—J. J. Swann
*Assistant Examiner*—Dinesh N Melwani
(74) *Attorney, Agent, or Firm*—Kathryn A. Marra

(57) ABSTRACT

A vehicle door latch has a forkbolt, a detent that holds the forkbolt in a latched position and a power operated release mechanism that moves the detent to release the forkbolt. The power operated release mechanism includes a power unlatching lever and a motor driven actuator having a jackscrew for moving the power unlatching lever via a slide, bell crank lever and bell crank link that provide a toggle enhancement. A mechanical override lever is provided to move the power unlatching lever in the event of power failure.

10 Claims, 3 Drawing Sheets

VEHICLE DOOR LATCH WITH POWER OPERATED RELEASE MECHANISM

This invention relates generally to a vehicle door latch and more particularly to a vehicle door latch that has a forkbolt, a detent for holding the forkbolt in a latched position and a release mechanism for moving the detent to a position releasing the forkbolt.

BACKGROUND OF THE INVENTION

An automotive closure, such as a door for an automobile passenger compartment, is hinged to swing between open and closed positions and conventionally includes a door latch that is housed between inner and outer panels of the door. The door latch functions in a well known manner to latch the door when it is closed and to lock the door in the closed position or to unlock and unlatch the door so that the door can be opened manually.

U.S. Pat. No. 6,053,543 granted to Frank Joseph Arabia et al Apr. 25, 2000, which is hereby incorporated by reference, discloses a vehicle door latch that has a forkbolt and a spring biased detent that holds the forkbolt in a latched position. The spring biased detent is moved by a manually operated release mechanism that includes an intermittent lever that operates on a pin that is attached to the detent. The lower end of the intermittent lever is pivotally attached to one end of an inside unlatching lever by a pivot pin. The other end of the inside unlatching lever has a generally perpendicular tab that is used for operating the unlatching lever by an inside door handle or the like. When the inside door handle or its equivalent rotates the unlatching lever, the intermittent lever is pulled down moving the pin and detent to a release position where the fork bolt is released allowing the vehicle door to be opened from inside the vehicle.

The release mechanism of the door latch also includes an outside release lever or unlatching lever. One end of the outside unlatching lever is pivotally mounted on a stud while the opposite end of the outside unlatching lever is adapted for operating the outside unlatching lever by an outside handle or the like. When the outside handle or its equivalent rotates the outside unlatching lever, the unlatching lever engages the pin attached to the intermittent lever and pulls the intermittent lever down moving the detent to a release position where the fork bolt is released allowing the vehicle door to be opened from outside the vehicle.

The door latch also includes an independent lock mechanism that includes the intermittent lever and that is preferably power operated. The lock mechanism has a compound lock lever and an inside lock lever and an outside lock lever that operate the compound lock lever. The compound lock lever locks the door latch by moving the intermittent lever to a disabling position where the intermittent lever does not move the detent when it is pulled down by the release mechanism. The door latch also includes an optional power operated double lock mechanism.

The door latch disclosed in the Arabia '543 patent is suitable for its intended purpose. Moreover, the door latch of the Arabia '543 patent is typical of the conventional approach of having a mechanically operated release mechanism and an independent lock mechanism that may or may not be power operated.

SUMMARY OF THE INVENTION

The vehicle door latch of the invention has a power operated release mechanism rather than a mechanically operated release mechanism that is typical of the prior art.

The power operated release mechanism eliminates the need for an independent lock mechanism since the vehicle door latch is locked simply by cutting off power to the power operated release mechanism. The vehicle door latch of the invention preferably includes a mechanical override to unlatch the vehicle door latch in the event of a power failure.

Objects, features and advantages of the invention will become apparent from the description below, which is given by way of example with reference to the accompanying drawings.

DESCRIPTION OF THE PREFERRED EMBODIMENT

Figure 1:
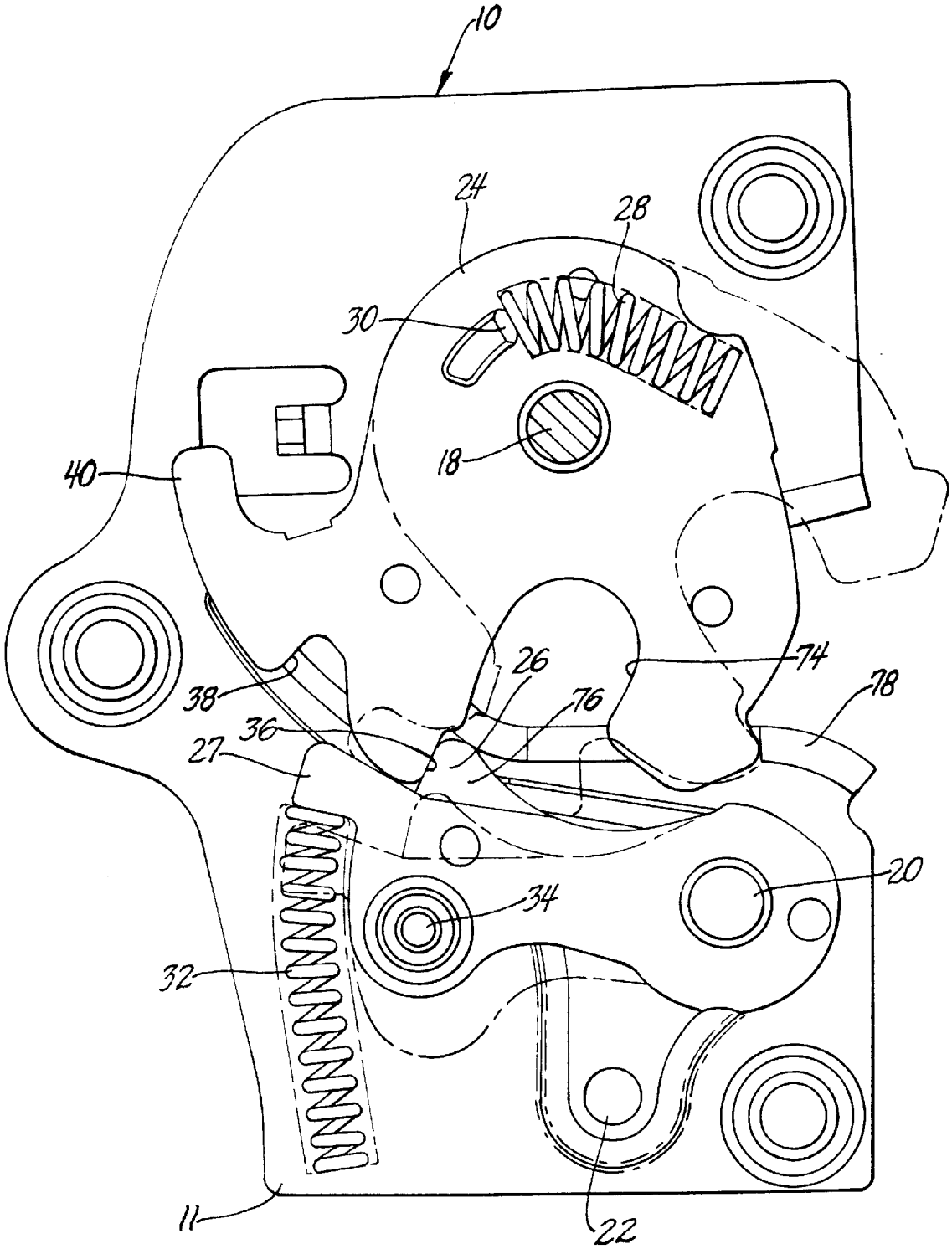
FIG. 1 is a partial front view of a vehicle door latch of the invention with parts removed to show operation of the latch mechanism.

Referring now to the drawing, the vehicle door latch 10 has a multi-piece enclosure that comprises a metal frame or face plate 11, a plastic housing 12, a plastic cover and an electric control frame. The cover and electric control frame are not shown in order to illustrate internal detail. The metal face plate 11 (FIG. 1) and the plastic housing 12 (FIGS. 2 and 3) are held together by three flanged studs 18, 20 and 22 that are inserted through three holes in an intermediate wall 16 of plastic housing 12, then through three aligned holes in the metal face plate and then flanged over the metal face plate to form a rearward compartment that is shown in FIG. 1.

Door latch 10 has a latch mechanism comprising a forkbolt 24 and a cooperating detent 26 that are located in the rearward compartment and pivotally mounted on rearward portions of studs 18 and 20 respectively. Forkbolt 24 is biased counterclockwise in FIG. 1 by a compression return spring 28 that is disposed in a curved slot in the intermediate wall 16 of the plastic housing 12 in front of forkbolt 24. Spring 28 engages a lateral lug 30 of forkbolt 24 at one end and an end wall of the curved slot at the other end. Detent 26 is biased clockwise in FIG. 1 into engagement with forkbolt 24 by a compression spring 32 that engages an ear 27 of detent 26 at one end. The opposite end of compression spring 32 engages an internal wall of housing 12.

Detent 26 engages forkbolt 24 at shoulder 36 and holds forkbolt 24 in a primary latched position against the bias of compression spring 28 as shown in solid line in FIG. 1. Detent 26 can also engage forkbolt 24 at shoulder 38 and hold it in an intermediate secondary latched position. Detent 26 engages forkbolt 24 at foot 40 in its unlatched or release position as shown in dashed line in FIG. 1.

Figure 2:
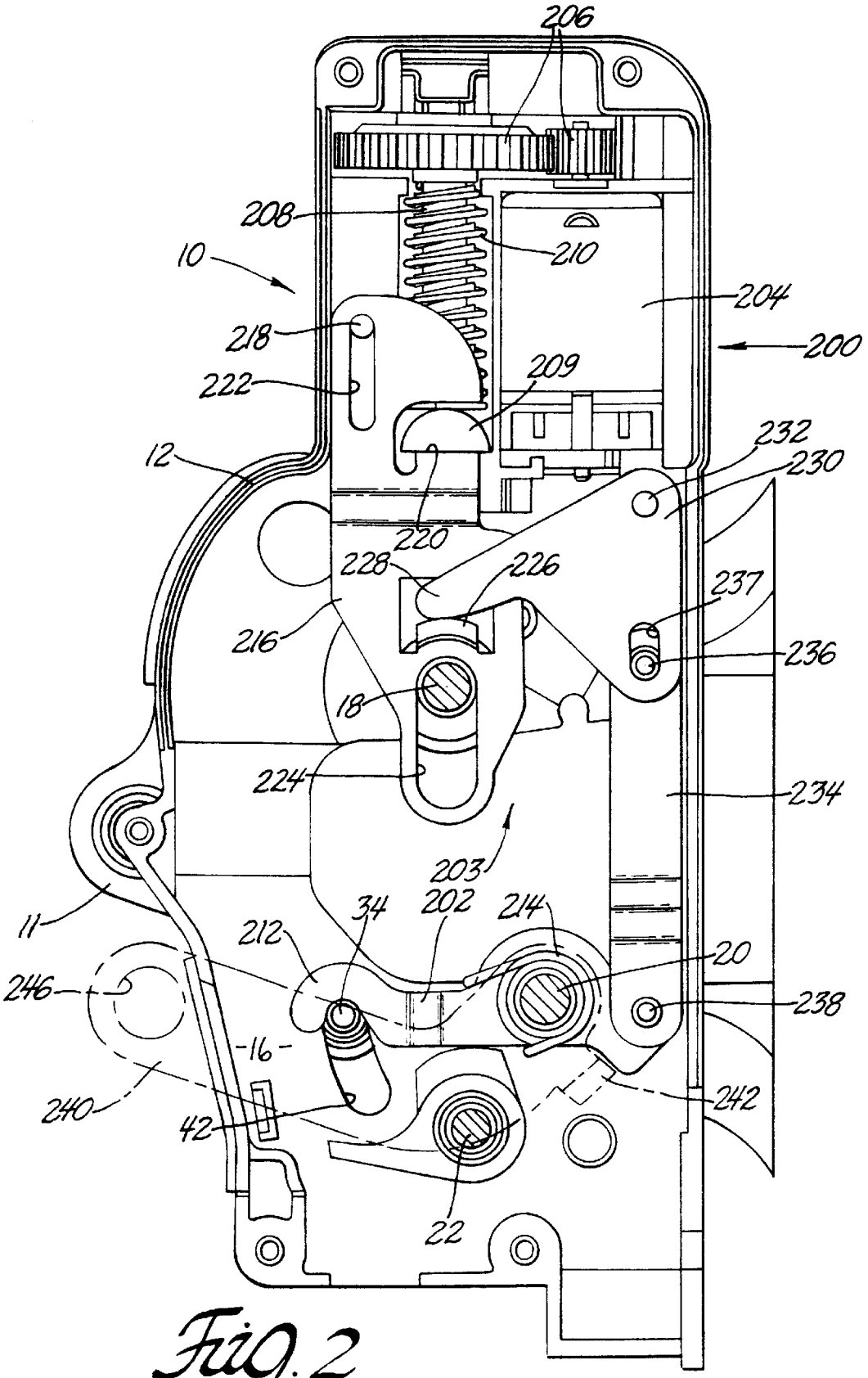
FIG. 2 is a front view of the vehicle door latch shown in FIG. 1 with parts removed to show operation of the power release mechanism.
Figure 3:
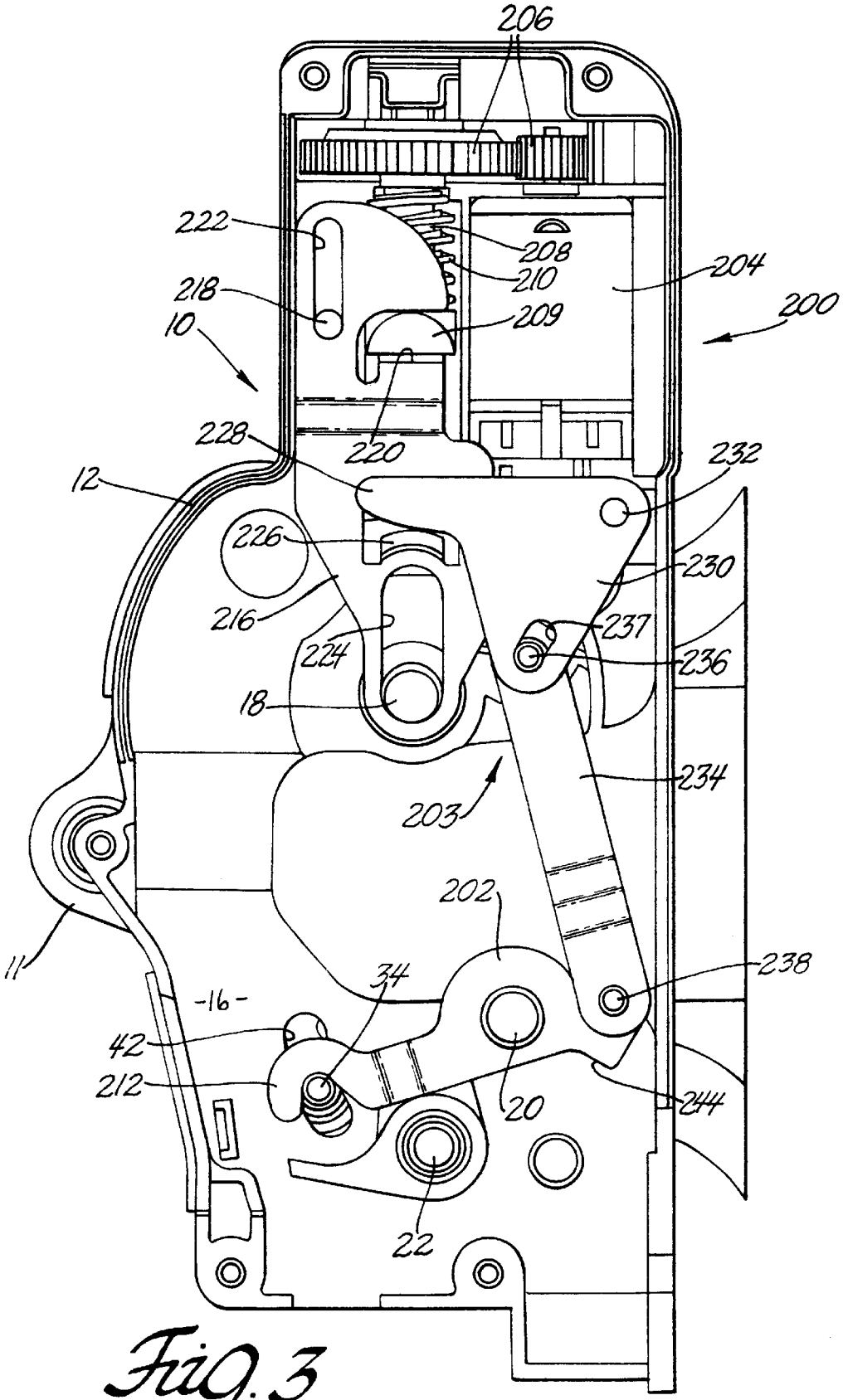
FIG. 3 is a another front view of the vehicle door latch shown in FIGS. 1 and 2 with parts removed to show operation of the power release mechanism.

Detent 26 has a lateral pin 34 that extends through housing slot 42 in intermediate wall 16 into a forward compartment formed by the intermediate wall 16 of the plastic housing 12 and the plastic cover (not shown) and the electric control frame (not shown) that are attached to the housing 12 by screws or the like. The forward compartment is illustrated in FIGS. 2 and 3. As indicated above the cover and electric control frame are removed in FIGS. 2 and 3 to facilitate illustration of internal detail.

Forkbolt 24 has a conventional slot or throat 74 for receiving and retaining a striker member of a conventional strike assembly that is attached to a vehicle door pillar (not shown) to latch the vehicle door in the closed position when forkbolt 24 is in the latched position as shown in solid line in FIG. 1. Forkbolt 24 also includes a primary latch shoulder 36, an intermediate secondary latch shoulder 38 and a radially projecting foot 40 as indicated above. Forkbolt 24 preferably has a plastic coating that covers a surface of the slot 74 that is engaged by the strike member for energy absorption and quiet operation when the vehicle door is slammed shut.

Detent 26 has a sector shaped catch 76 that engages the radially projecting foot 40 when the forkbolt 24 is in the unlatched position shown in dashed lines in FIG. 1. The sector shaped catch 76 positively engages the primary and secondary latch shoulders 36 and 38 to hold the forkbolt 24 in either the primary latched position (FIG. 1) or the intermediate secondary latched position (not shown).

When the door latch 10 is in an unlatched and unlocked condition, forkbolt 24 is poised to receive the striker member as shown in dashed lines in FIG. 1. The striker member projects into fish mouth slot 78 of the metal face plate 11 and an aligned fish mouth slot of the plastic housing when the door is shut. The entering striker member engages the back of the throat 74 and rotates forkbolt 24 clockwise against the bias of compression spring 28 until forkbolt 24 is rotated to the primary latch position shown in solid line in FIG. 1 where forkbolt 24 captures the striker member in throat 74. Forkbolt 24 is held in the primary latch position by catch 76 of detent 26 engaging primary latch shoulder 36 of forkbolt 24.

Catch 76 rides along the periphery of the forkbolt 24 under the bias of compression spring 32 as forkbolt 24 rotates clockwise from the unlatched position to the primary latch position shown in FIG. 1 in dashed and solid line respectively. During this travel, catch 76 rides under the foot 40 into engagement with the intermediate secondary latch shoulder 38 and then into engagement with the primary latch shoulder 36. The engagement of catch 76 with the intermediate secondary latching shoulder 38 is sufficient to hold the vehicle door closed in the event that the vehicle door is not shut with sufficient force so that catch 76 engages primary latch shoulder 36.

The power operated release mechanism of the invention will now be described in connection with FIGS. 2 and 3.

The power operated release mechanism 200 comprises a power unlatching lever 202 that is pivotally mounted on stud 20. A motor driven actuator 203 rotates the power unlatching lever 202 between a generally horizontal rest position shown in FIG. 2 and an unlatch position shown in FIG. 3. The power unlatching lever 202 has a hook 212 at one end engaging and moving the detent 26 via detent pin 34 to the position releasing the forkbolt 24 when the power unlatching lever 202 rotates from the rest position shown in FIG. 2 to the unlatch position shown in FIG. 3. A spring 214 biases the power unlatching lever 202 clockwise toward the rest position shown in FIG. 2.

Motor driven actuator 203 comprises an electric motor 204, a gear set 206 and a jackscrew 208 located in the upper portion of the forward compartment ahead of wall 16. Jackscrew 208 is rotated by the electric motor 204 via gear set 206. When rotated, jack screw 208 drives an output nut 209 that translates in the vertical direction between a rest position shown in FIG. 2 and a raised unlatch position shown in FIG. 3. A compression spring 210 biases output nut 209 downwardly toward the rest position shown in FIG. 2.

Motor driven actuator 203 further includes a slide 216 that slides in the vertical direction guided by a guide pin 218 of housing 12 and stud 18 that slide in guide slots 222, 224 of slide 216, respectively. Slide 216 is coupled to nut 209 by a slot 220 that traps nut 209 so that nut 209 drives slide 216 up or down in the vertical direction. Slide 216 has a cam tab 226 that engages a follower arm 228 of a bell crank lever 230 that rotates about a fixed pivot 232 of housing 12. A bell crank link 234 is pivotally connected to the bell crank lever 230 at one end by a second pivot 236. An opposite end of bell crank link 234 in turn is pivotally connected to an opposite end of the power unlatching lever 202 by a third pivot 238.

Pivots 232, 236 and 238 are preferably aligned substantially linearly in the vertical direction when the power unlatching lever 202 is in the horizontal rest position as shown in FIG. 2. This arrangement results in a toggle action whereby the lift force that is applied to arm 228 of the bell crank lever 230 by slide 216 (and that rotates bell crank lever 230 clockwise) is multiplied substantially when the lift force of bell crank link 234 is applied to the power unlatching lever 202 at the pin connection 238 to rotate power unlatching lever 202 counterclockwise. This force multiplication reduces the power and size requirements for electric motor 204 considerably and results in a compact design.

Pivot 238 connecting bell crank link 234 to unlatching lever 202 allows only relative pivotal motion between the parts. On the other hand, pivot 236 is preferably a pin and slot arrangement that permits relative translatory motion as well as relative pivotal motion between bell crank lever 232 and bell crank link 234. Pivot 236 is pulled down to the bottom of slot 237 as shown in FIG. 2 by unlatching lever 202 being biased clockwise by spring 214. The pin and slot arrangement that permits relative translatory motion between bell crank lever 232 and bell crank link 234 is desirable in connection with the manual or override unlatching operation described below.

The power operated release mechanism 200 operates as follows. A control switch is actuated that energizes electric motor 204 through a motor control circuit to drive jackscrew 208 counterclockwise for a predetermined amount of time. The control switch can be manually operated, radio operated or automatically operated responsive to vehicular drive or both. Such control switches and motor control circuits are well known in the art and need not be described in detail.

Suffice it to state that electric motor 204 is preferably energized to drive jackscrew 208 counterclockwise for a short period of time moving output nut 209 up from the rest position shown in FIG. 2 to the unlatch position shown in FIG. 3. This raises slide 216 which pivots bell crank lever 230 clockwise about fixed pivot 232 and moves pivot 236 to the left from the rest position of FIG. 2 to the unlatch position of FIG. 3. Bell crank 234 in turn pivots bell crank link 234 about pivot 238 while simultaneously raising pivot 238 with a force that is multiplied substantially because of the toggle effect. Raising pivot 238 pivots power unlatching lever 202 counterclockwise which pushes detent pin 34 down as shown in FIG. 3. Pushing detent pin 34 down pivots detent 26 counterclockwise against the bias of spring 32 from the solid line position shown in FIG. 1 to the release position shown in dashed lines. This releases fork bolt 24 allowing the vehicle door (not shown) to be opened.

When electric motor 204 is deenergized power unlatching lever 202 is returned to the rest position of FIG. 2 by torsion spring 214. Torsion spring 214 also returns bell crank lever 230 and bell crank link 234 to the rest position of FIG. 2 by pulling down on bell crank lever 234 via power unlatching lever 202. In the mean time, slide 216 and nut 209 are returned to the rest position of FIG. 2 by return spring 210 which back drives electric motor 204.

The vehicle door latch 10 is locked simply by opening a switch in the motor control circuit so that electric motor 204 cannot be energized. This "lock" switch can be controlled by a key lock cylinder, sill button or any other operator via a suitable mechanical linkage.

In the event of a power failure, the power operated release mechanism 200 can be overridden mechanically by a manual override lever 240. The manual override lever 240 is shown in phantom in FIG. 2. Override lever 240 and torsion spring 214 are not shown n FIG. 3. Override lever 240 is pivotally mounted on stud 20 on top of the power unlatching lever 202. Override lever 240 has an ear 242 at or near the pivot end that engages a shoulder 244 of power unlatching lever 202 when both levers are in the rest position as shown in FIG. 2. The opposite or free end of override lever 240 has a hole 246 or other structure for connecting override lever 240 to inside and outside operators suitable via mechanical linkages (not shown). The outside operator should be a key lock cylinder or located in a locked compartment to maintain the integrity of the lock described above.

To unlatch mechanically, manual override lever 240 is rotated counterclockwise from the rest position shown in FIG. 2 to an unlatch position about 15 degrees counterclockwise from the position shown in FIG. 2. When so moved, manual unlatching lever 240 rotates power unlatching lever 202 to the unlatch position shown in FIG. 3 and door latch 10 is unlatched as described above. However, when pivot 38 is raised by manual unlatching lever 240 via unlatching lever 202, bell crank link 234 merely raises straight up with pivot 236 sliding up in slot 237 of bell crank lever 230. Thus bell crank lever 230 remains stationary and in contact with cam tab 226 without the necessity of back driving motor 204.

While electric motor 204 is preferably energized for a specific time, the motor 204 could simply be energized and used in conjunction with a limit switch to deenergize the motor when forkbolt 24 is released. In other words, many modifications and variations of the present invention in light of the above teachings may be made. It is, therefore, to be understood that, within the scope of the appended claims, the invention may be practiced otherwise Man as specifically described.

What is claimed is:

1. A vehicle door latch having a forkbolt that moves between a latched position and an unlatched position and a detent for holding the forkbolt in the latched position, characterized by a power operated release mechanism for moving the detent to a position releasing the forkbolt, the power operated release mechanism comprising:

a power unlatching lever moveable from a rest position to an unlatch position the power unlatching lever engaging the detent or a part connected to the detent and moving the detent to the position releasing the forkbolt when the power unlatching lever moves from the rest position to the unlatch position, and a motor driven actuator that is operatively connected to the power unlatching lever for moving the power unlatching lever from the rest position to the unlatch position, the motor driven actuator including a bell crank lever that is rotated about a first pivot and a bell crank link that is pivotally connected to the bell crank lever at one end by a second pivot and that is pivotally connected to the power unlatching lever at the other end by a third pivot, the first pivot, the second pivot and the third pivot being aligned substantially linearly when the power unlatching lever is in the rest position to hold the power unlatching lever in the rest position.

2. A vehicle door latch having a forkbolt that moves between a latched position and an unlatched position and a detent for holding the forkbolt in the latched position, characterized by a power operated release mechanism for moving the detent to a position releasing the forkbolt, the power operated release mechanism comprising:

a power unlatching lever moveable from a rest position to an unlatch position the power unlatching lever engaging the detent or a part connected to the detent and moving the detent to the position releasing the forkbolt when the power unlatching lever moves from the rest position to the unlatch position, and a motor driven actuator that is operatively connected to the power unlatching lever for moving the power unlatching lever from the rest position to the unlatch position, the motor driven actuator including a bell crank lever and a bell crank link that is pivotally connected to the bell crank lever at one end and that is pivotally connected to the power unlatching lever at the other end, and the motor driven actuator further including a slide that engages and pivots the bell crank lever to move the power unlatching lever to the unlatch position.

3. A vehicle door latch having a forkbolt that moves between a latched position and an unlatched position and a detent for holding the forkbolt in the latched position, characterized by a power operated release mechanism for moving the detent to a position releasing the forkbolt, the power operated release mechanism comprising:

a power unlatching lever moveable from a rest position to an unlatch position the power unlatching lever engaging the detent or a part connected to the detent and moving the detent to the position releasing the forkbolt when the power unlatching lever moves from the rest position to the unlatch position, and a motor driven actuator that is operatively connected to the power unlatching lever for moving the power unlatching lever from the rest position to the unlatch position, the motor driven actuator including a bell crank lever and a bell crank link that is pivotally connected to the bell crank lever at one end and that is pivotally connected to the power unlatching lever at the other end, and the power unlatching lever being pivotally mounted in the vehicle door latch and spring biased toward the rest position, the power unlatching lever being held in the rest position by the bell crank lever and the bell crank link.

4. The vehicle door latch as defined in claim 3 wherein the motor driven actuator includes a slide that engages and pivots the bell crank lever to move the power unlatching lever to the unlatch position, and a jackscrew that has an output nut that engages the slide.

5. A vehicle door latch having a forkbolt that moves between a latched position and an unlatched position and a detent for holding the forkbolt in the latched position characterized by a power operated release mechanism for moving the detent to the position releasing the forkbolt, the power operated release mechanism comprising:

a power unlatching lever that rotates from a rest position to an unlatch position, the power unlatching lever having a hook at one end engaging and moving the detent via a detent pin to the position releasing the forkbolt when the power unlatching lever rotates from the rest position to the unlatch position, a torsion spring biasing the power unlatching lever toward the rest position, and a motor driven actuator for moving the power unlatching lever from the rest position to the unlatch position, the motor driven actuator including a motor, a slide that is driven by the motor, a bell crank lever that is rotated about a first pivot by the slide, and a bell crank link that is pivotally connected to the bell crank lever at one end by a second pivot and that is pivotally connected to an opposite end of the power unlatching lever at an opposite end of the bell crank link by a third pivot.

6. The vehicle door latch as defined in claim 5 wherein the first pivot, the second pivot and the third pivot are aligned substantially linearly when the power unlatching lever is in the rest position to hold the power unlatching lever in the rest position.

7. The vehicle door latch as defined in claim 5 wherein the second pivot or the third pivot is a pin and slot arrangement so that the power unlatching lever can be rotated to the unlatching position without back driving the bell crank lever.

8. The vehicle door latch as defined in claim 5 wherein the motor driven actuator includes a jackscrew having a output nut that drives the slide, and a coil return spring that engages the output nut to return the output nut to the rest position, the power unlatching lever being returned to the rest position by the torsion spring.

9. The vehicle door latch as defined in claim 5 further including an override lever that is engageable with the power unlatching lever to move the power unlatching lever to the unlatch position in the event of power failure.

10. The vehicle door latch as defined in claim 9 wherein the second pivot or the third pivot is a pin and slot arrangement so that the power unlatching lever can be rotated to the unlatching position by the override lever without back driving the bell crank lever.

* * * * *